US005578900A

United States Patent [19]

Peng et al.

[11] Patent Number: 5,578,900

[45] Date of Patent: Nov. 26, 1996

[54] BUILT IN ION PUMP FOR FIELD EMISSION DISPLAY

[75] Inventors: Chao-Chi Peng, Chinchu; Chun-hui Tsai, Hsinchu, both of Taiwan

[73] Assignee: Industrial Technology Research Institute, Hsin-Chu, Taiwan

[21] Appl. No.: 551,317

[22] Filed: Nov. 1, 1995

[51] Int. Cl.[6] ..... H01J 1/62; H01J 63/04; H01J 1/02; H01J 1/16

[52] U.S. Cl. ..... 313/495; 313/309; 313/336; 445/41

[58] Field of Search ..... 313/306, 309, 313/311, 336, 346 R, 351, 495, 496, 553, 554, 558, 556, 562, 547, 549; 417/48, 49; 445/24, 41

[56] References Cited

U.S. PATENT DOCUMENTS

| | | | |
|---|---|---|---|
| 5,063,323 | 11/1991 | Longo et al. | 313/309 |
| 5,083,958 | 1/1992 | Longo et al. | 445/24 |
| 5,223,766 | 6/1993 | Nakayama et al. | 313/495 |

*Primary Examiner*—Sandra L. O'Shea
*Assistant Examiner*—Mack Haynes
*Attorney, Agent, or Firm*—George O. Saile; Stephen B. Ackerman

[57] ABSTRACT

A field emission display having an ion pump, for removal of outgassed material, is described. The display has a baseplate and an opposing face plate. A substrate acts as a base for the baseplate. There are parallel, spaced conductors acting as cathode electrodes, over the substrate. An insulating layer covers the cathode electrodes and the substrate, and parallel, spaced conductors act as gate electrodes and overlay the insulating layer. There is a plurality of openings extending through the insulating layer and the gate electrodes. At each of the openings is a field emission microtip connected to and extending up from one of the cathode electrodes. The faceplate has a glass base and is mounted opposite and parallel to the baseplate. A conducting anode electrode covers the glass base. There is a pattern of phosphorescent material over the conducting anode electrode, so that when electrons which are emitted from the field emission microtips strike the pattern of phosphorescent material, light is emitted, as well as outgassed material. Ion pump cathode electrodes formed of a gettering material cover the gate electrodes, so that during display operation the outgassed material is collected at the ion pump cathode electrodes. Alternately, the ion pump cathode may be formed on a focusing electrode, on a focusing mesh, or on other electrode structures.

20 Claims, 8 Drawing Sheets

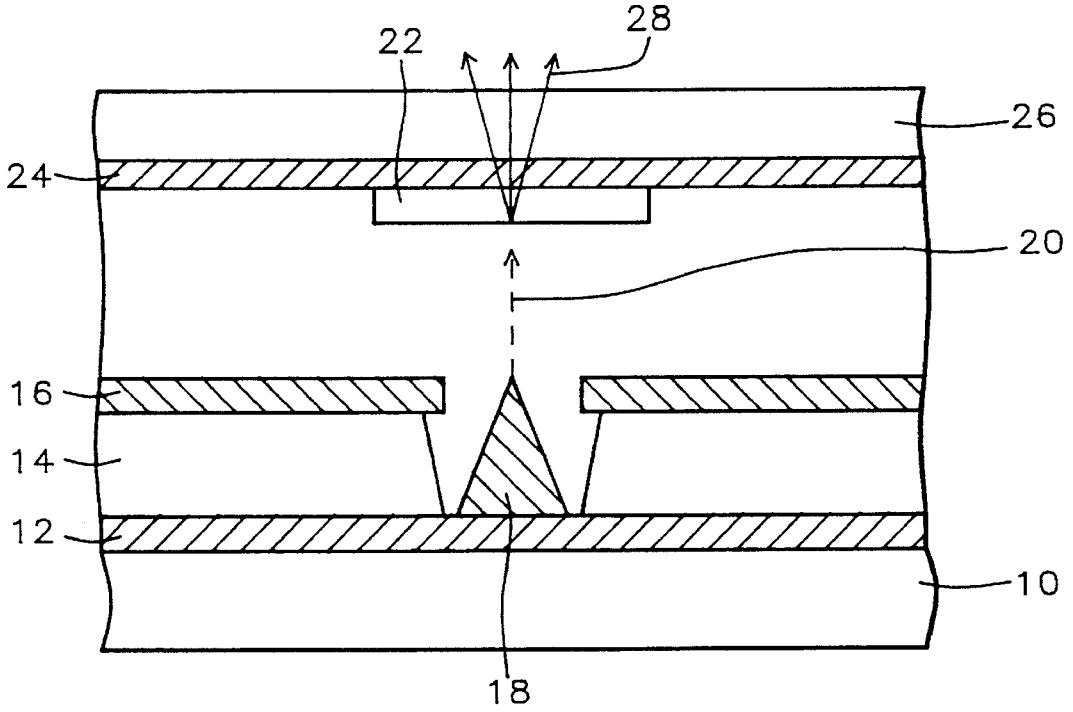
FIG. 1 – Prior Art
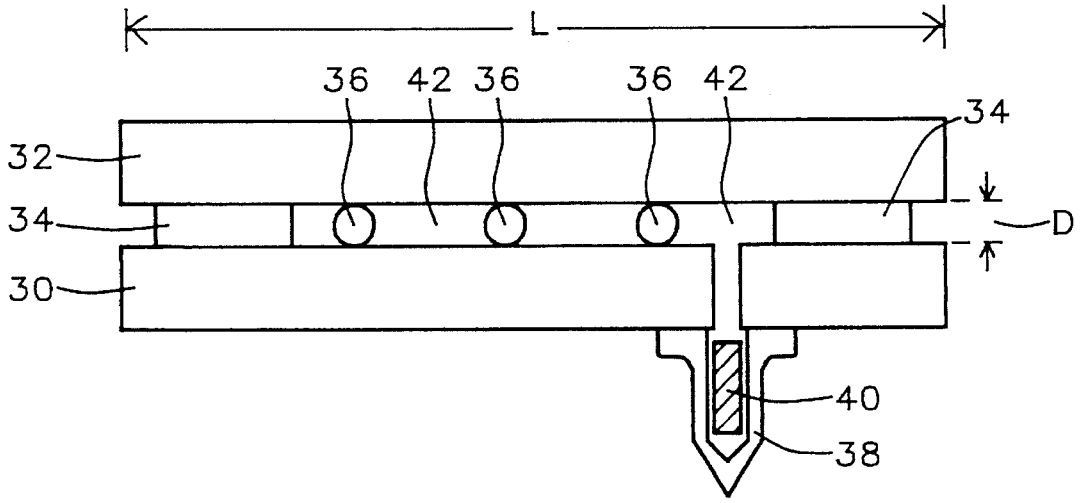
FIG. 2 – Prior Art

BUILT IN ION PUMP FOR FIELD EMISSION DISPLAY

BACKGROUND OF THE INVENTION (1) Field of the Invention

The invention relates to field emission displays, and more particularly to structures and methods of manufacturing field emission displays with a built in ion pump, for eliminating outgassed material from within the display.

(2) Description of the Related Art

There is a growing need in the computer and electronics industries for thin, lightweight display panels. One application for such thin displays is for portable computers. The most commonly used display panel at the current time is the liquid crystal display (LCD), but because of the slow optical response time of the liquid crystal pixel and because of its relatively poor luminosity, other display technologies are being actively explored.

One such technology which has the potential to provide faster response times and increased brightness, while maintaining a thin profile and low power consumption, is the Field Emission Display (FED). As shown in FIG. 1, an FED typically consists of an array of small cold cathode electron emitters 18 mounted on a substrate 10, from which emitted electrons 20 are accelerated through an evacuated space to an opposing anode 24. The emitted electrons strike cathodoluminescent material 22 (phosphors), causing light 28 to be emitted, which may be viewed through a glass viewing surface 26 on which the anode and phosphors are mounted.

The array of very small, conically shaped electron emitters is electrically accessed by peripheral control and image forming circuits, using two arrays of conducting lines that from columns and rows. The array of column lines form the cathode contacts 12 on which the conical electron emitters are formed. The array of row conducting lines form gate electrodes 16 that are separated by a dielectric layer 14 from the column lines. The column lines 12 are formed on the substrate 10, and both the gate electrodes 16 and dielectric layer 14 have openings over the column lines, in which the emitters 18 are formed. The edges of the openings in the gate electrodes are in close proximity to the emitter tip, and function as the electrically addressable gate electrode 16, or control grid, for the individual electron emitters 18. A second, focusing, electrode (not shown) may be formed separated from and over the gate electrode, to provide narrower, more focused, electron streams as the electrons are emitted and accelerated toward the anode.

The proper functioning of the FED relies on maintaining an adequate vacuum within the cavity between the substrate on which the emitters are formed, and the transparent viewing plate. However, the vacuum can be degraded, during operation of the display, by outgassing from the materials from which the FED is fabricated. Outgassing primarily occurs when emitted electrons strike the anode/phosphor and cause trapped molecular gases or solids to be released. The outgassed materials not only degrade the vacuum but may also cause undesirable arcing within the FED, which can ultimately lead to destruction of the display.

To achieve and maintain a good vacuum, it is common practice in the vacuum tube industry to utilize a gettering material, such as barium (Ba), tantalum (Ta), titanium (Ti), zirconium (Zr) and the like, to absorb outgassed matter. Gettering material has also been utilized in FED technology, with one example shown in FIG. 2. Cathode plate 30, including the emitters (not shown) is separated from anode plate 32 by sealing walls 34. Spacers 36 are usually placed between the cathode and anode plates, to prevent the atmospheric pressure external to the display from distorting the anode plate after evacuation of FED. The cavity 42 between the plates is evacuated through the exhaust tube 38 by vacuum pumping means, and then sealed off to maintain a high vacuum in the display. Gettering material 40, in the prior art design of FIG. 2, is positioned within the exhaust tube 38. This provides a convenient means for heating, and thereby activating, the localized gettering source, after the exhaust tube 38 has been sealed off.

However, gettering materials localized in the exhaust tube are not very effective at absorbing volatile material from the FED cavity. The FED is usually large in size, on the order of 1–20 centimeters in width (denoted as L in FIG. 2), as compared to the small distance D between the cathode and anode plates of between about 100 to 1000 micrometers. The outgassed material is not very effectively removed due to the narrow passageway and remote location of the gettering material.

One method of providing improved gettering efficiency is described in U.S. Pat. No. 5,083,958 (Longo, et al.), in which additional interconnecting channels are formed between the base for the field emitters and the gate electrode, thus providing additional channels for the outgassed material to escape. However, the gettering material is formed on the peripheral inner walls of the FED, and are still a considerable distance from the outgassing surfaces. Local undesirable pressure increases can still occur during operation of this FED design, and gas conductance is low. In addition, extra space is required around the periphery of the display elements.

Another method of removing the outgassed materials is disclosed in U.S. Pat. No. 5,223,766 (Nakyama, et at.), in which the gate electrodes themselves are composed of non-evaporable gettering materials, such as alloys of tantalum (Ta), zirconium (Zr), titanium (Ti) and hafnium (Hf). Thus the getter is in close proximity to the anode surface from which outgassing occurs. However, this causes process compatibility problems in the fabrication of the display—since the etching rate of most gettering materials by hydrofluoric acid (HF) is about 10 times faster that of silicon oxide ($SiO_2$), the gate electrodes will be seriously attacked by HF in the SiO2 cavity formation step (see FIG. 7).

SUMMARY OF THE INVENTION

It is therefore an object of this invention to provide a field emission display with improved efficiency at removing outgassed materials, to maintain an adequate vacuum within the display cavity.

It is a further object of this invention to provide a field emission display, and a method of making it, that has improved outgassing efficiency and that is compatible with manufacturing methods for fabricating such a display.

These objects are achieved by a field emission display having an ion pump, the display having a baseplate and an opposing face plate. A substrate acts as a base for the baseplate. There are parallel, spaced conductors acting as cathode electrodes, over the substrate. An insulating layer covers the cathode electrodes and the substrate, and parallel, spaced conductors act as gate electrodes and overlay the insulating layer. There is a plurality of openings extending through the insulating layer and the gate electrodes. At each of the openings is a field emission microtip connected to and extending up from one of the cathode electrodes. The faceplate has a glass base and is mounted opposite and parallel to the baseplate. A conducting anode electrode covers the glass base. There is a pattern of phosphorescent material over the conducting anode electrode, so that when electrons which are emitted from the field emission microtips strike the pattern of phosphorescent material, light is emitted, as well as outgassed material. Ion pump cathode electrodes formed of a gettering material cover the gate electrodes, so that during display operation the outgassed material is collected at the ion pump cathode electrodes. Alternately, the ion pump cathode may be formed on a focusing electrode, on a focusing mesh, or on other electrode structures.

BRIEF DESCRIPTION OF THE DRAWINGS

FIG. 1 is a cross-sectional representation of a portion of a prior art field emission display.

FIG. 2 is a cross-sectional representation of a portion of a prior art field emission structure in which gettering material is placed in an exhaust tube.

DESCRIPTION OF THE PREFERRED EMBODIMENTS

Figure 3:
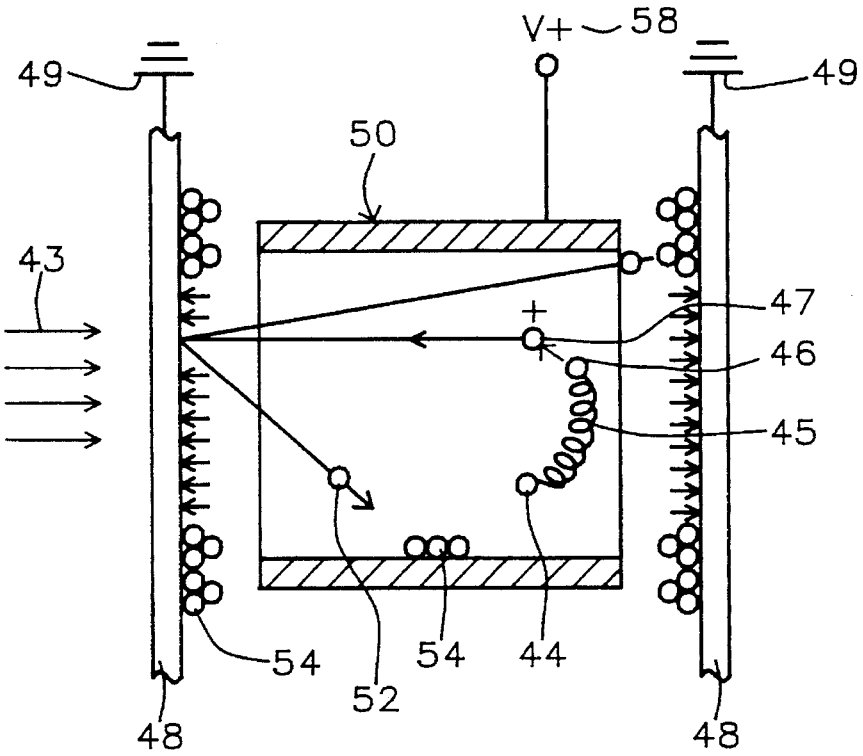
FIGS. 3 and 4 are schematic representations of the operation of an ion pump.
Figure 4:
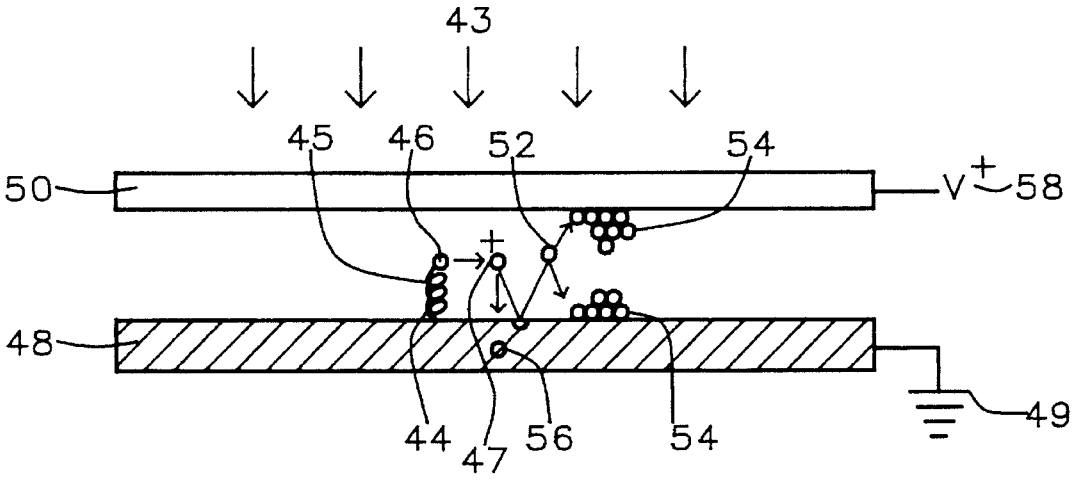

Referring now to FIGS. 3 and 4, the theory of operation of an ion pump is described. In a sputter-ion pump, as shown in FIG. 3, the magnetic field 43 forces electrons 44 to move in a spiral path 45, increasing the possibility of a collision between electrons and neutral gas particles 46. Such a collision causes ionization of the gas, and positive ions 47 impinge upon cathode 48. Cathode 48, which is formed of titanium or the like, is kept at ground potential 49 while the anode 50 is raised to a voltage 58 of between about 100 and 8000 volts.

The impinging electrons cause sputtering of the cathode material 52, which is deposited at other locations 54 such as on the cathode and anode plates. The deposited material at these locations acts as a getter film and adsorbs reactive gas particles, such as nitrogen (N), oxygen (0) or hydrogen (H). Some of the ionized gas particles 56 (FIG. 4) are adsorbed into cathode surface 48 by ion implantation.

An ion pump using a simpler two-plate (one cathode, one anode) structure is shown in FIG. 4, with the same reference characters used to indicate the same elements earlier described with reference to FIG. 3.

Figure 5:
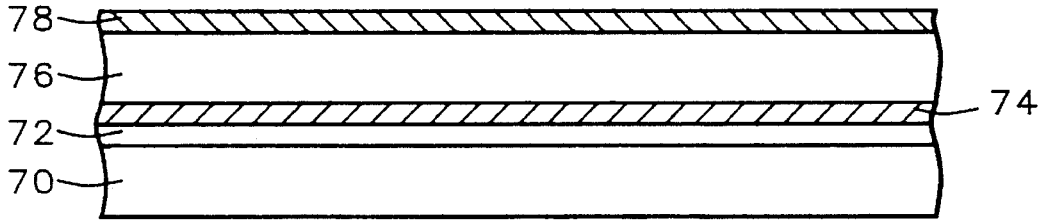
FIG. 5 to 14 are cross-sectional representations of one method of the invention for manufacturing a field emission display having a built in ion pump.

The novel structure and method of fabricating an FED having an integrated ion pump is now described. Referring to FIG. 5, a substrate 70 is provided and is typically formed of glass or silicon. An insulating adhesion layer 72 is formed over the substrate. A conductive layer 74 is formed and patterned into parallel, spaced conductors to be used as cathode strips for the FED. This layer may be formed of a metal such as Mo (molybdenum), Nb (niobium) or Aluminum (A1), and is deposited by evaporation or sputtering, as is known in the art. An insulating layer 76 having a thickness of between about 0.3 and 2 micrometers, and formed of silicon oxide ($SiO_2$) or the like, is next deposited, by CVD (Chemical Vapor Deposition).

A conductive film 78 is next formed over insulator 76, typically of a metal such as niobium (Nb) or molybdenum (Mo), to a thickness of between about 0.2 and 0.5 micrometers. This film will later be patterned and will comprise the gate electrode for the FED, which when raised to an appropriate voltage potential with respect to the cathode will stimulate field emission of electrons from the field emitter tips.

Figure 6:
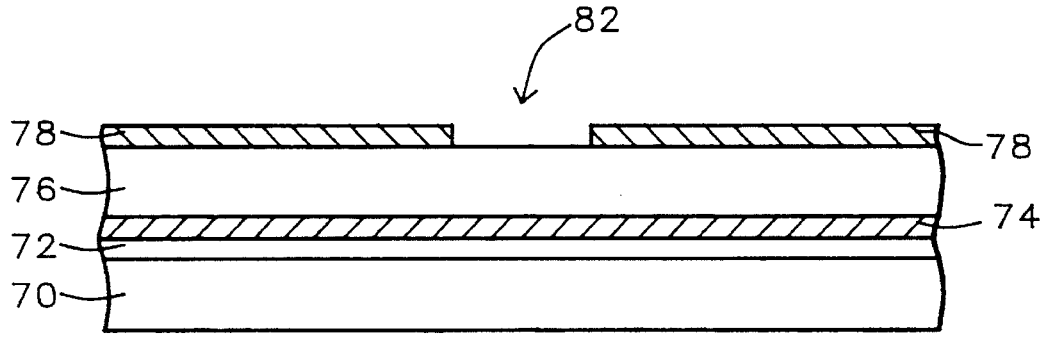
Figure 7:
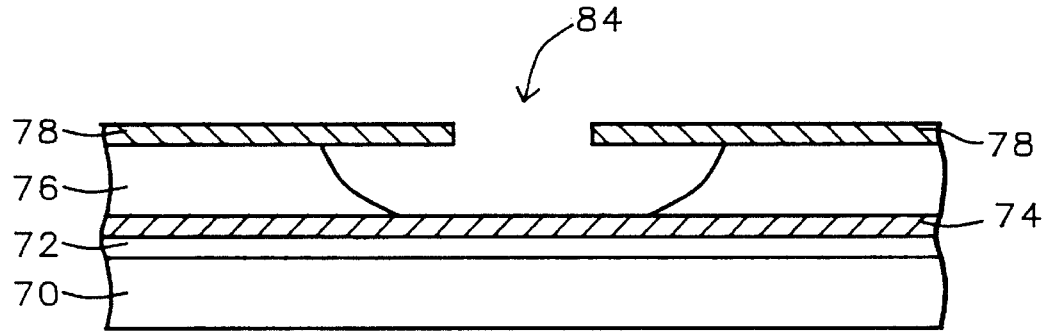

Patterning of the upper electrode layer 78 must now be performed, to create openings at the desired locations of the field emission microtips. Many thousands of microtips are typically formed in an FED, in an array pattern, whereas the figures included show only a small subset of this number. A photoresist mask (not shown) with the desired pattern of openings is formed over metal film 78, by conventional lithography. Etching of the metal film is then performed to create opening 82, as shown in FIG. 6, using reactive ion etching. As shown in FIG. 7, an isotropic etch of dielectric 76 is performed using an HF solution, to complete the opening 84 for subsequent formation of the microtips.

Figure 8:
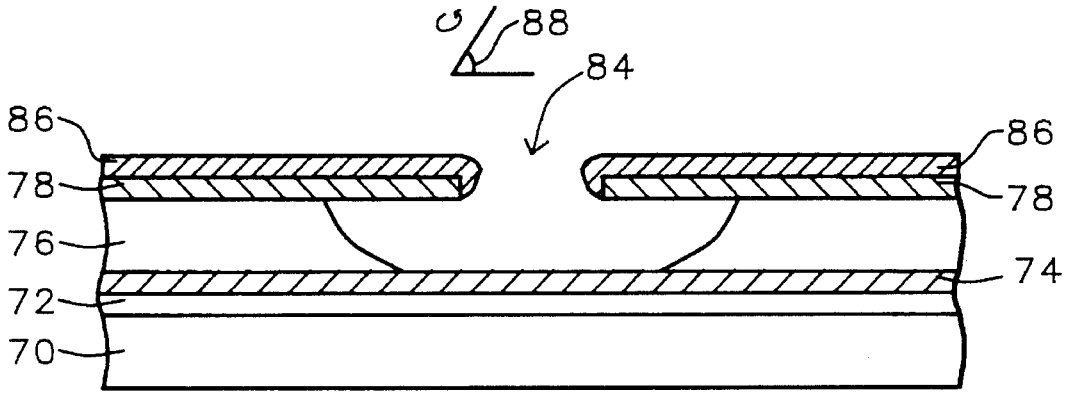
Figure 9:
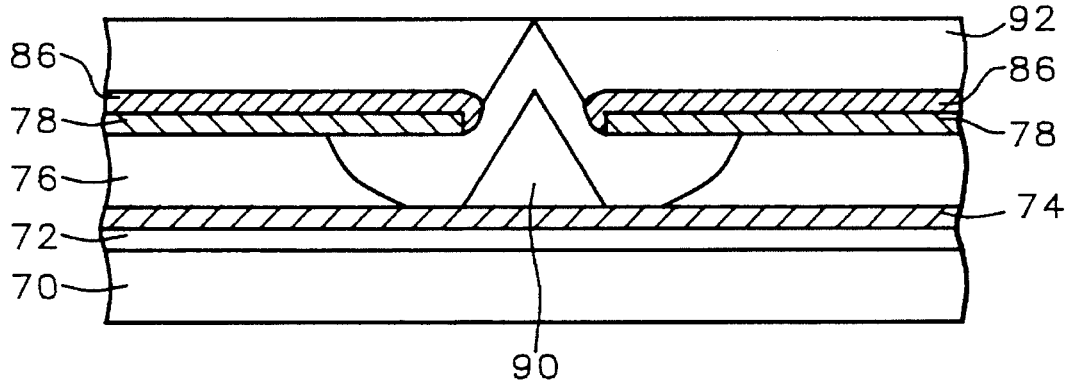
Figure 10:
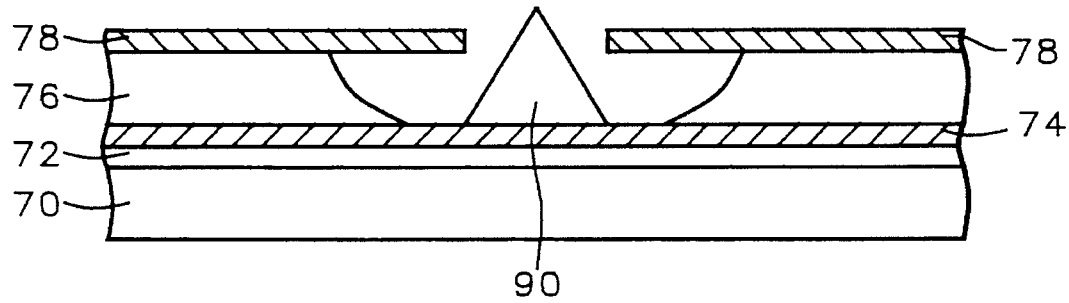

Referring now to FIGS. 8–10, the backplate of the FED is completed by methods which are known in the art. A sacrificial layer 86 is formed by graze angle deposition. The wafer on which the structure is being formed is rotated and tilted at an angle 88 of about 75°, so that the sacrificial layer 86 is formed over the top and along the inner sidewalls of electrode layer 78, without any deposition further within opening 84. This layer is formed of aluminum, nickel, or the like by e-beam evaporation, to a thickness of between about 1000 and 3000 Angstroms.

The field emitter microtip 90 is now formed by vertical evaporation of molybdenum (Mo), copper (Cu), or the like. The evaporation continues until the closure layer 92 completely closes off the opening where the emitter is formed. The emitter is formed to a height of between about 0.5 and 2 micrometers. Closure layer 92 and sacrificial layer 90 are removed by dissolving the sacrificial layer, resulting in the structure shown in FIG. 10.

Figure 11:
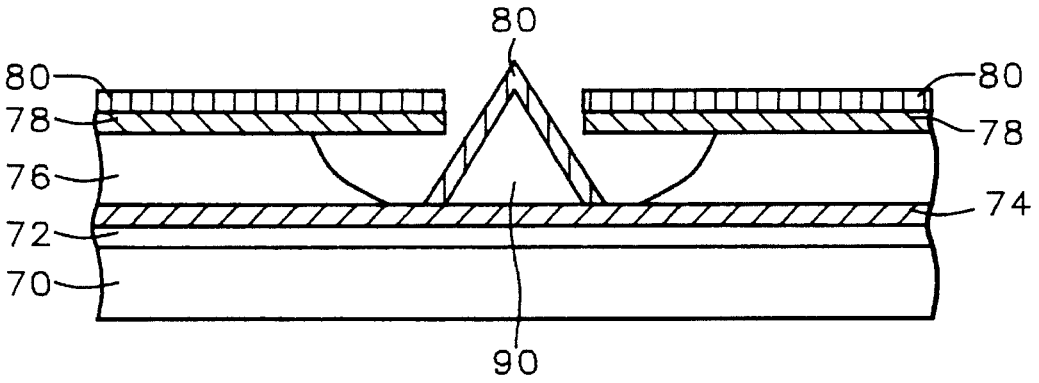

In an important step of this method of the invention, referring to FIG. 11, a second conductive film 80 is now blanket deposited, and will form the cathode for the integrated ion pump. A gettering material is used, and is selected from groups IIA, IIIB, IVB, VB and VIB of the periodic table, and includes Sc (scandium), Ti, V (vanadium), Cr (chromium), Y (yttrium), Zr (zirconium), Nb, Mo, La (lanthanum), Hf (hafnium), Ta and W (tungsten), or may be deposited using alloys containing at least one of the metals from groups IIA, IIB, IV, VB and VIB. The preferred materials to be used for the ion pump cathode are Ti, Zr, Hf, Sc, Y and La, since these materials are more active with $O_2$, $N_2$, $CH^+$, CO and $CO_2$. The conductive film 80 is deposited by E-beam evaporation to a thickness of between about 0.01 and 2 micrometers.

Figure 12:
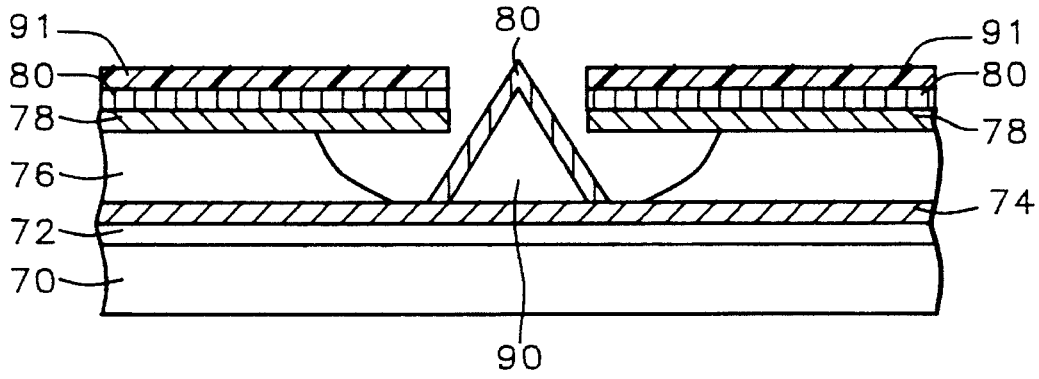
Figure 13:
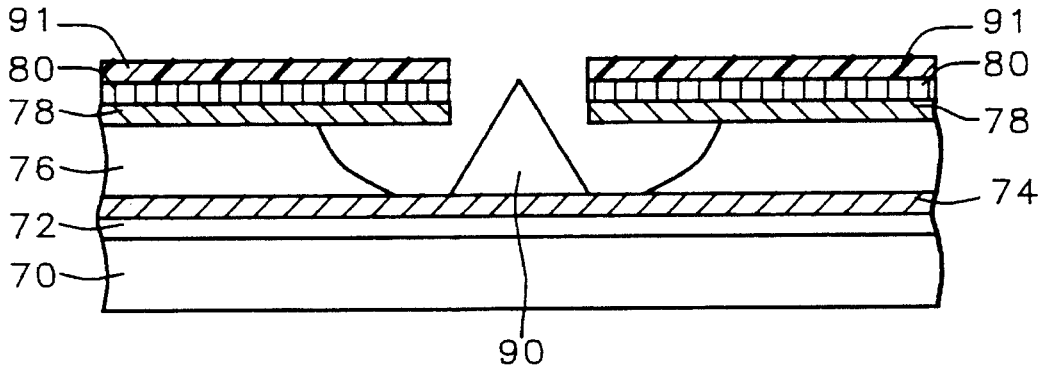
Figure 14:
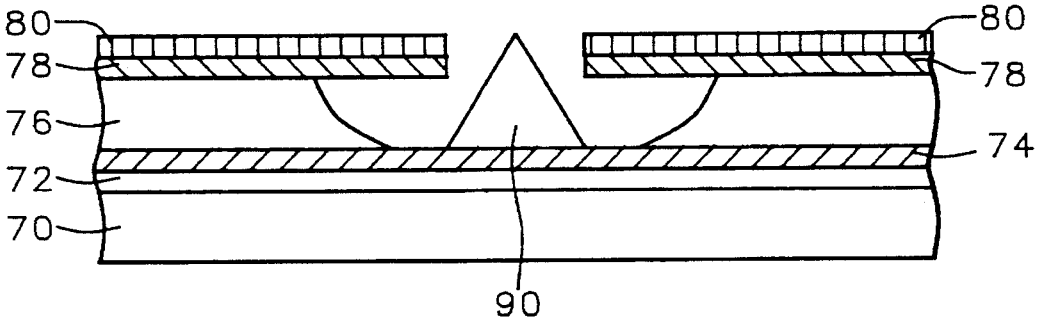

With reference to FIGS. 12–14, a photoresist film 91 is now formed over conductive film 80, using conventional lithography and etching, so that the photoresist is formed over the horizontal surfaces of conductive film 80 but not in the emitter tip openings 82. The film 80 over emitter tips 90 is removed by etching, in order to expose the tips, and then the photoresist 91 is removed to complete the backplate structure of FIG. 14.

Figure 15:
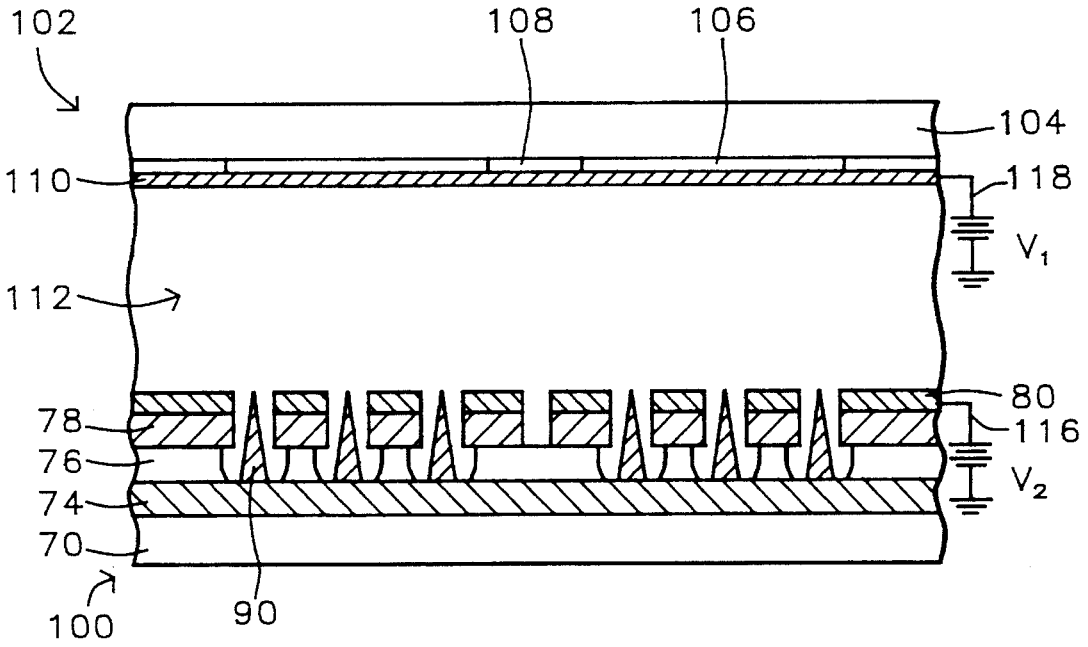
FIG. 15 is a cross-sectional representation of the resultant structure of the invention in which the ion pump cathode is formed over the FED gate electrode.

Operation of the FED, and the built in ion pump of the invention, will now be described with reference to FIG. 15. During manufacture of the FED, a faceplate 102 is mounted in close proximity to the backplate 100, and includes glass 104, phosphor 106, black matrix 108 (for contrast between phosphors), and anode 110, as previously described. The cavity 112 between the two plates is evacuated and sealed during the manufacture of the display. Operation of the FED is performed by applying the appropriate voltages to the cathode 74, gate electrode 78 and anode 110, using voltage sources 116 ($V_1$) and 118 ($V_2$), respectively. During normal operation of an FED, electron emission is induced by a difference in voltage between the gate 78 and the cathode 76. The voltage at the anode 110 is typically operated at a higher voltage than at the gate 78 in order to accelerate electrons emitted form the emitter tip to the anode. For the ion pump to operate, the difference in voltages $V_1-V_2$ has to be between about 100 and 8000 volts, so it can be seen the ion pump will operate during the normal operating conditions of the FED.

Another way of operating the ion pump is by placing the FED in a magnetic field, then operating the FED in its normal conditions—the magnetic field enhances the ion pump efficiency.

Figure 16:
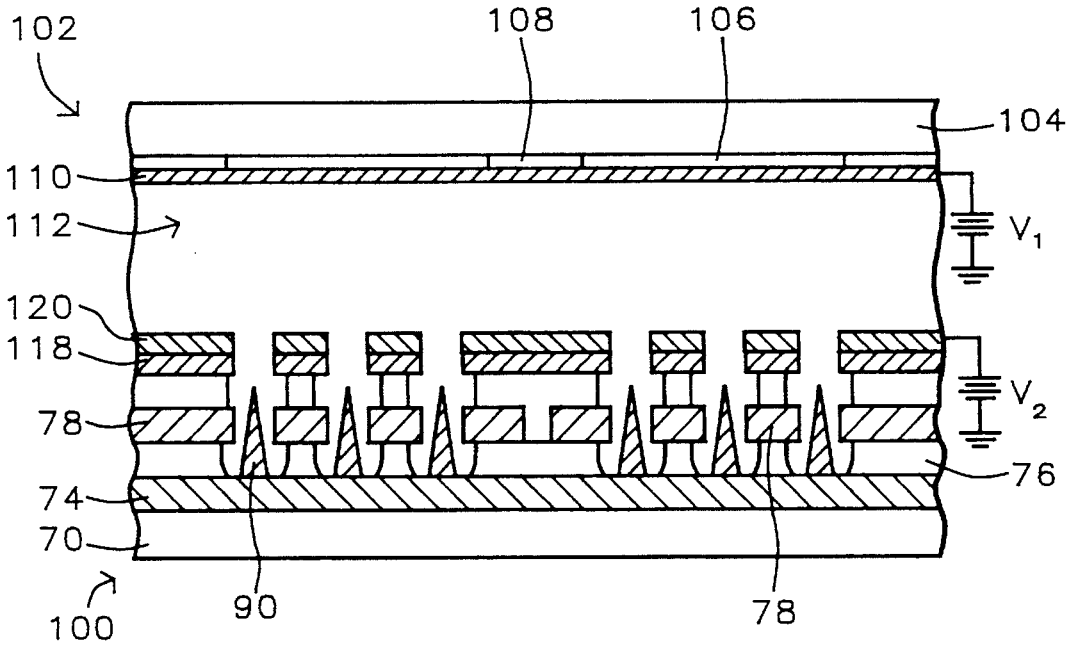
FIG. 16 is a cross-sectional representation of the resultant structure of the invention in which the ion pump cathode is formed over an FED focusing electrode.

In a second embodiment of the invention, as depicted in FIG. 16, the ion pump cathode 120 may be used in conjunction with a focusing electrode 118. A focusing electrode is used in an FED to provide a narrower, more focused stream of electrons from each emitter tip, therefore decreasing the size of the spot of light emitted from the phosphor. Manufacturing of this embodiment of the invention is similar to that described earlier, with the focusing electrode 118 made of similar materials as the gate electrode 78, and the ion pump cathode 120 made of the gettering materials earlier described. The ion pump will operate as long as the difference in voltages between the anode and gettering material is between 100 and 8000 volts.

Figure 17:
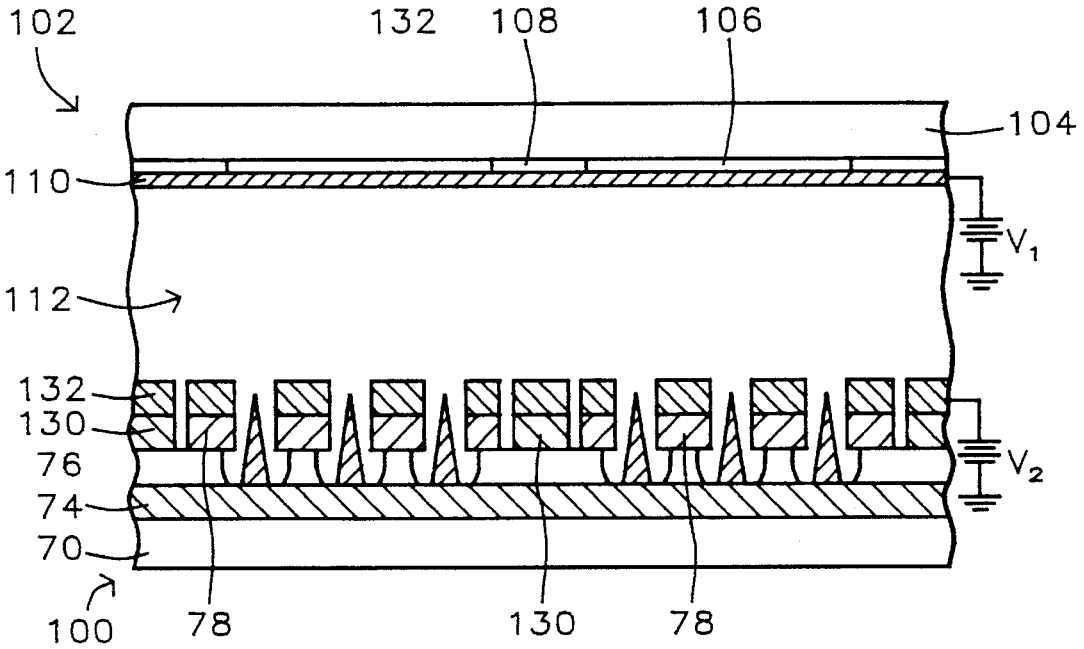
FIG. 17 is a cross-sectional representation of the resultant structure of the invention in which the ion pump cathode is formed over an additional FED electrode.

As can be seen, the built-in ion pump of the invention may be used in conjunction with different electrode configurations, such as the gate electrode and focusing electrodes described above. Other electrode configurations may be desired and it will be recognized by those skilled in the art that these are within the scope of the invention. An example is depicted in FIG. 17, in which an additional electrode 130 is formed on the same plane as gate electrode 78, and over which is formed the ion pump cathode 132 of the invention. Operation is as earlier described.

Figure 18:
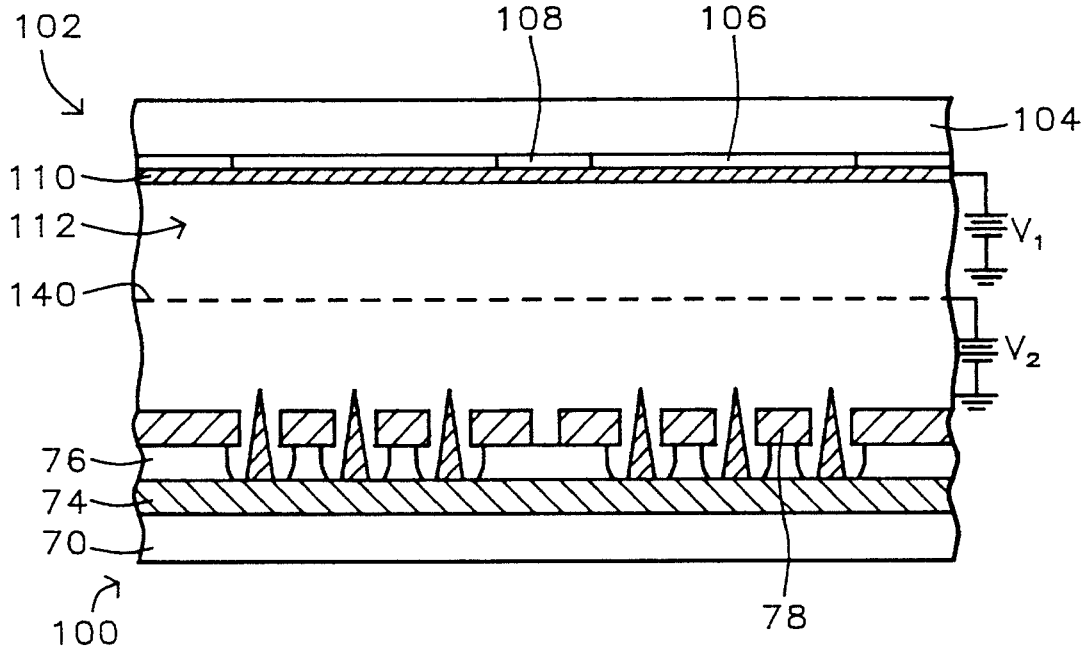
FIG. 18 is a cross-sectional representation of the resultant structure of the invention in which the ion pump cathode is formed as part of an FED focus mesh.

Referring now to FIG. 18, a final embodiment of the invention is depicted in which a focusing mesh 140 is used in conjunction with the FED, being placed between the backplate and faceplate of the FED and acting as both a focusing means and an ion pump cathode.

While the invention has been particularly shown and described with reference to the preferred embodiments thereof, it will be understood by those skilled in the art that various changes in form and details may be made without departing from the spirit and scope of the invention.

What is claimed is:

1. A field emission display having an ion pump, said display having a baseplate and an opposing face plate, comprising:

a substrate acting as a base for said baseplate;

parallel, spaced conductors acting as cathode electrodes, over said substrate;

an insulating layer over said cathode electrodes and said substrate;

parallel, spaced conductors acting as gate electrodes, over said insulating layer;

a plurality of openings extending through said insulating layer and said gate electrodes;

at each of said openings is a field emission microtip connected to and extending up from one of said cathode electrodes;

said faceplate having a glass base, mounted opposite and parallel to said baseplate;

a pattern of phosphorescent material over said glass base;

a conducting anode electrode over said phosphorescent material, whereby when electrons which are emitted from said field emission microtips strike said pattern of phosphorescent material, light is emitted, as well as outgassed material; and ion pump cathode electrodes formed of a gettering material, over said gate electrodes, whereby during display operation said outgassed material is collected at said ion pump cathode electrodes.

2. The field emission display of claim 1 wherein said gettering material is selected from the group consisting of titanium (Ti), zirconium (Zr), hafnium (Hf), scandium(Sc), Yttrium (Y), and lanthanum (La).

3. The field emission display of claim 1 wherein said gettering material is selected from the group consisting of alloys of titanium (Ti), zirconium (Zr), hafnium (Hf), (Sc), Yttrium (Y), and lanthanum (La).

4. The field emission display of claim 1 wherein said gettering material is selected from the group consisting of vanadium (V), chromium (Cr), zirconium (Zr), niobium (Nb), molybdenum (Mo), tantalum (Ta) and tungsten (W).

5. The field emission display of claim 1 further comprising:

additional conducting structures, formed in the same plane as said gate electrodes, over said insulating layer; and an extension of said ion pump cathode electrodes, over said additional conducting structures.

6. The field emission display of claim 1 wherein said ion pump cathode electrodes have a thickness of between about 0.01 and 2 micrometers.

7. The field emission display of claim 1 wherein said conducting anode electrode acts as an anode for said ion pump.

8. The field emission display of claim 1 wherein said backplate and faceplate are separated by a distance of between about 10 and 1000 micrometers.

9. A field emission display having an ion pump, said display having a baseplate and an opposing face plate, comprising:

a substrate acting as a base for said baseplate; parallel, spaced conductors acting as cathode electrodes, over said substrate;

a first insulating layer over said cathode electrodes and said substrate;

parallel, spaced conductors acting as gate electrodes, over said first insulating layer;

a second insulating layer over said gate electrodes;

parallel, spaced conductors acting as focusing electrodes, over said second insulating layer;

a plurality of openings extending through said first and second insulating layers and said gate and focusing electrodes;

at each of said openings is a field emission microtip connected to and extending up from one of said cathode electrodes;

said faceplate having a glass base, mounted opposite and parallel to said baseplate;

a pattern of phosphorescent material over said glass base;

a conducting anode electrode over said phosphorescent material, whereby when electrons which are emitted from said field emission microtips strike said pattern of phosphorescent material, light is emitted, as well as outgassed material; and ion pump cathode electrodes formed of a gettering material, over said focusing electrodes, whereby during display operation said outgassed material is collected at said ion pump cathode electrodes.

10. The field emission display of claim 9 wherein said gettering material is selected from the group consisting of titanium (Ti), zirconium (Zr), hafnium (Hf), scandium (Sc), Yttrium (Y), and lanthanum (La).

11. The field emission display of claim 9 wherein said gettering material is selected from the group consisting of alloys of titanium (Ti), zirconium (Zr), hafnium (Hf), scandium (Sc), Yttrium (Y), and lanthanum (La).

12. The field emission display of claim 9 wherein said ion pump cathode electrodes have a thickness of between about 0.01 and 2 micrometers.

13. The field emission display of claim 9 wherein said conducting anode electrode acts as an anode for said ion pump.

14. The field emission display of claim 9 wherein said backplate and faceplate are separated by a distance of between about 10 and 1000 micrometers.

15. A method of manufacturing a field emission display having an ion pump, comprising the steps of:

providing a substrate having a first conducting layer thereon, a first insulating layer over said first conducting layer, and a second conducting layer over said first insulating layer;

patterning said second conducting layer to form parallel, spaced conductors having first openings, to act as gate electrodes for said display;

forming second openings in said first insulating layer, under said first openings;

forming a sacrificial layer over said second conducting layer;

forming field emission microtips in said second openings, whereby a closure layer is formed over said second conducting layer;

removing said sacrificial layer and said closure layer;

forming a third conducting layer over said second conducting layer and over said field emission microtips, wherein said third conducting layer is formed of a gettering material;

forming a photoresist layer over that portion of said third conducting layer that is formed over said second conducting layer;

removing said third conducting layer from the surface of said field emission microtips; and removing said photoresist layer.

16. The method of claim 15 wherein said gettering material is selected from the group consisting of titanium (Ti), zirconium (Zr), hafnium (Hf), (Sc), Yttrium (Y), and lanthanum (La).

17. The method of claim 16 wherein said third conducting layer is formed to a thickness of between about 0.01 and 2 micrometers.

18. A method of manufacturing a field emission display having an ion pump, comprising the steps of:

providing a substrate having a first conducting layer thereon, a first insulating layer over said first conducting layer, a second conducting layer over said first insulating layer, and a second insulating layer over said second conducting layer, and a third conducting layer over said second insulating layer;

patterning said third conducting layer to form parallel, spaced conductors having first openings, to act as a focusing electrode for said display;

forming second openings in said second insulating layer, said second conductive layer and said first insulating layer, under said first openings;

forming a sacrificial layer over said third conducting layer;

forming field emission microtips in said second openings, whereby a closure layer is formed over said third conducting layer;

removing said sacrificial layer and said closure layer;

forming a fourth conducting layer over said third conducting layer and over said field emission microtips, wherein said fourth conducting layer is formed of a gettering material;

forming a photoresist layer over that portion of said fourth conducting layer that is formed over said third conducting layer;

removing said fourth conducting layer from the surface of said field emission microtips; and removing said photoresist layer.

19. The method of claim 18 wherein said gettering material is selected from the group consisting of titanium (Ti), zirconium (Zr), hafnium (Hf), (Sc), Yttrium (Y), and lanthanum (La).

20. The method of claim 18 wherein said fourth conducting layer is formed to a thickness of between about 0.01 and 2 micrometers.

* * * * *